United States Patent [19]

Rhode

[11] 4,244,199

[45] Jan. 13, 1981

[54] WARP KNIT ELASTIC TAPE CONSTRUCTION FOR USE AS WAISTBAND REINFORCEMENT

[75] Inventor: Werner Rhode, LaGrange, Ga.

[73] Assignee: Milliken Research Corporation, Spartanburg, S.C.

[21] Appl. No.: 54,722

[22] Filed: Jul. 5, 1979

Related U.S. Application Data

[63] Continuation of Ser. No. 875,476, Feb. 6, 1978, abandoned, which is a continuation of Ser. No. 759,819, Jan. 17, 1977, abandoned.

[51] Int. Cl.[3] ..... D04B 23/10

[52] U.S. Cl. ..... 66/193; 66/202

[58] Field of Search ..... 66/190, 192, 193, 195, 66/202

[56] References Cited

U.S. PATENT DOCUMENTS

| | | | |
|---|---|---|---|
| 2,692,842 | 10/1954 | Dildilian | 66/193 |
| 3,118,294 | 1/1964 | Van Laethem | 66/193 |
| 3,570,482 | 3/1971 | Emoto et al. | 66/193 X |
| 3,673,820 | 7/1972 | Sarmiento | 66/193 X |
| 3,757,541 | 9/1973 | Frohlich et al. | 66/193 |
| 4,003,224 | 1/1977 | Odham | 66/193 |
| 4,009,597 | 3/1977 | Wall et al. | 66/193 |
| 4,034,579 | 7/1977 | Tillon | 66/193 X |
| 4,075,874 | 2/1978 | Heimberger | 66/192 |

FOREIGN PATENT DOCUMENTS

| | | | |
|---|---|---|---|
| 691512 | 7/1963 | Italy | 66/195 |

*Primary Examiner*—Ronald Feldbaum

*Attorney, Agent, or Firm*—Earle R. Marden; H. William Petry

[57] ABSTRACT

An elastic warp knit fabric having a relatively stiff monofilament inlaid in the fabric between the courses thereof in a sinusoidal fashion so that the reverse portions of the monofilament did not extend to the outer extremities of the fabric. In one form of the invention a skirt is provided on one side of the fabric to decrease the possibility of cutting the monofilament when being connected for use as a waistband for body conforming garment.

4 Claims, 11 Drawing Figures

WARP KNIT ELASTIC TAPE CONSTRUCTION FOR USE AS WAISTBAND REINFORCEMENT

This is a continuation of application Ser. No. 875,476, filed Feb. 6, 1978, now abandoned which in turn is a continuation of Ser. No. 759,819, filed Jan. 17, 1977 now abandoned.

The present invention is directed to an elastic warp knit fabric construction and its method of manufacture, and, more particularly, to an elastic warp knit narrow tape or band fabric particularly suitable for use as a waistband support in garments.

It is known to employ narrow elastic fabric bands or tapes having longitudinal stretchability and good transverse stability in the waist portion of garments, such as skirts, slacks, and pants, to provide positional support of the garments on the wearer. In such garments, it is desirable that the elastic band or tape have a high degree of stretch and elastic recovery in the longitudinal direction to fit waists of varying size and to provide support of the garment on the wearer. It is also desirable that such bands be of sufficient width to be comfortable to the wearer and to have widthwise stability against rolling, twisting or bending of the tape in the garment during wear.

Such elastic fabric bands typically consist of a narrow knitted or woven tape containing elastic yarns, such as spandex or rubber, disposed in the longitudinal or warp direction and relatively large and stiff monofilament synthetic yarns such as nylon, employed in the transverse or weft (fill) direction to resist the tendency of the tape to roll or twist on the wearer's waist during use. Although such tapes can be produced individually on narrow looms or needle looms, it is desirable for economy of production, particularly in handling and finishing, to manufacture the tapes from wide or full width fabrics from which can be suitably cut after finishing into individual narrow widths.

It is recognized that in waistband support tapes employing relatively large, stiff weft yarns that there is a tendency for the sharp ends of the weft yarns at the outer side edges of the tape to stick the wearer and be uncomfortable during use. When such tapes are made by cutting a wide woven or knit fabric into narrow strips, the sharp cut ends of the yarns are often subsequently coated with a suitable polymeric resin to provide a protective bead or covering on the cut edges of the fill yarns and reduce their roughness during wear. Typical of such textile fabrics and their production are described in U.S. Pat. No. 3,597,300. It can be appreciated that the additional coating of the edges of the fabric bands to protect the wearer from the rough edges of the stiff weft yarns requires additional processing steps in the manufacturing operation. Even if the tapes are made individually on narrow looms or small needle looms, the stiff fill yarns extending to the outer edges of the tape can produce discomfort for the wearer.

It is an object of the present invention to provide a narrow width elastic fabric band or tape construction particularly suited for use as an elastic waist support in garments which overcomes to a large extent certain of the problems experienced in the prior art. More particularly, the present invention is directed to the production of an elastic warp knit fabric band construction having the desired stretch and elastic recovery in the longitudinal direction and employing rigid monofilament yarns in the widthwise direction for stability against roll, and wherein the stiff monofilament yarns are effectively maintained within, or inside, the side edges of the band to greatly reduce discomfort to the wearer. The invention also provides a method of producing such warp knit elastic bands in an economical manner by knitting a wide width fabric construction from which the bands can be easily separated into individual tapes.

The warp knit elastic fabric construction of the present invention comprises a plurality of sets of relatively inelastic yarn forming a knitted ground construction, sets of elastic yarns inlaid therein to provide longitudinal stretch, and a set of stiff monofilament yarns to provide good transverse dimensional stability against bending or rolling of the tapes during their use. Additionally, the construction may contain a plurality of covering yarns, such as textured yarns, to effectively hide the elastic yarns in the tape construction.

The narrow elastic fabric bands of the present invention are preferably produced by knitting a wide width fabric construction which can be economically finished in wide width form, and which thereafter can be easily separated into the multiple fabric bands without cutting. The elastic band construction also maintains the relatively stiff monofilament yarns inside the side edges of the band so as to eliminate the necessity of a subsequent edge-coating operation to prevent discomfort to the wearer during use and to prevent accidental severing of the fabric during the garment forming operation.

Other objects and advantages of the invention will become readily apparent as the specification proceeds to describe the invention, in which.

Figure 1:
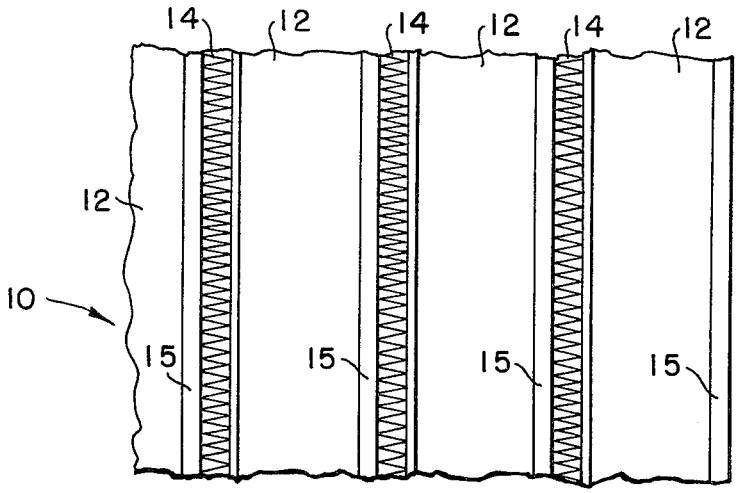
FIG. 1 is a top schematic view of the new and improved knitted elastic waistband fabric.
Figure 3:
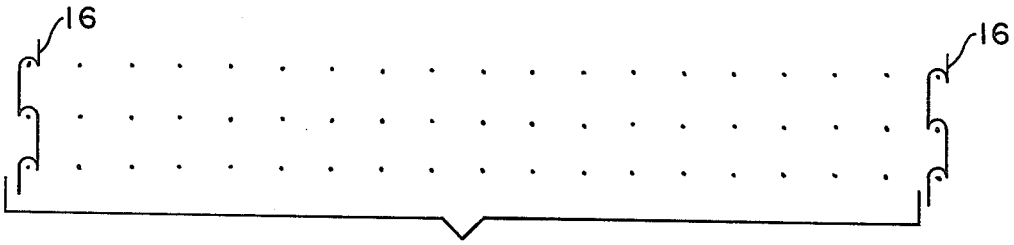
FIGS. 3–11 are point diagrams of each of the individual action of the guide bars of the knitting machine.
Figure 4:
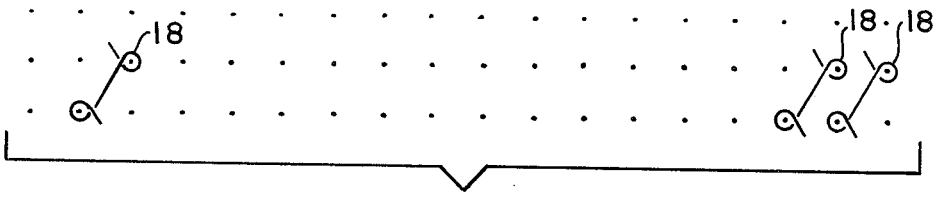

Looking now to FIG. 1, the fabric 10 is shown schematically as it comes off the knitting machine with individual widths 12 of the fabric being connected together on the knitting machine by a connecting yarn 14 in order to knit a plurality of waistband tapes 12 at the same time. In the preferred form of the invention, each of the tapes 12 are approximately one inch (1") in width and have a skirt portion 15, having a width of approximately one-eighth inch ($\frac{1}{8}$"), at one side thereof for reasons hereinafter explained.

Figure 2:
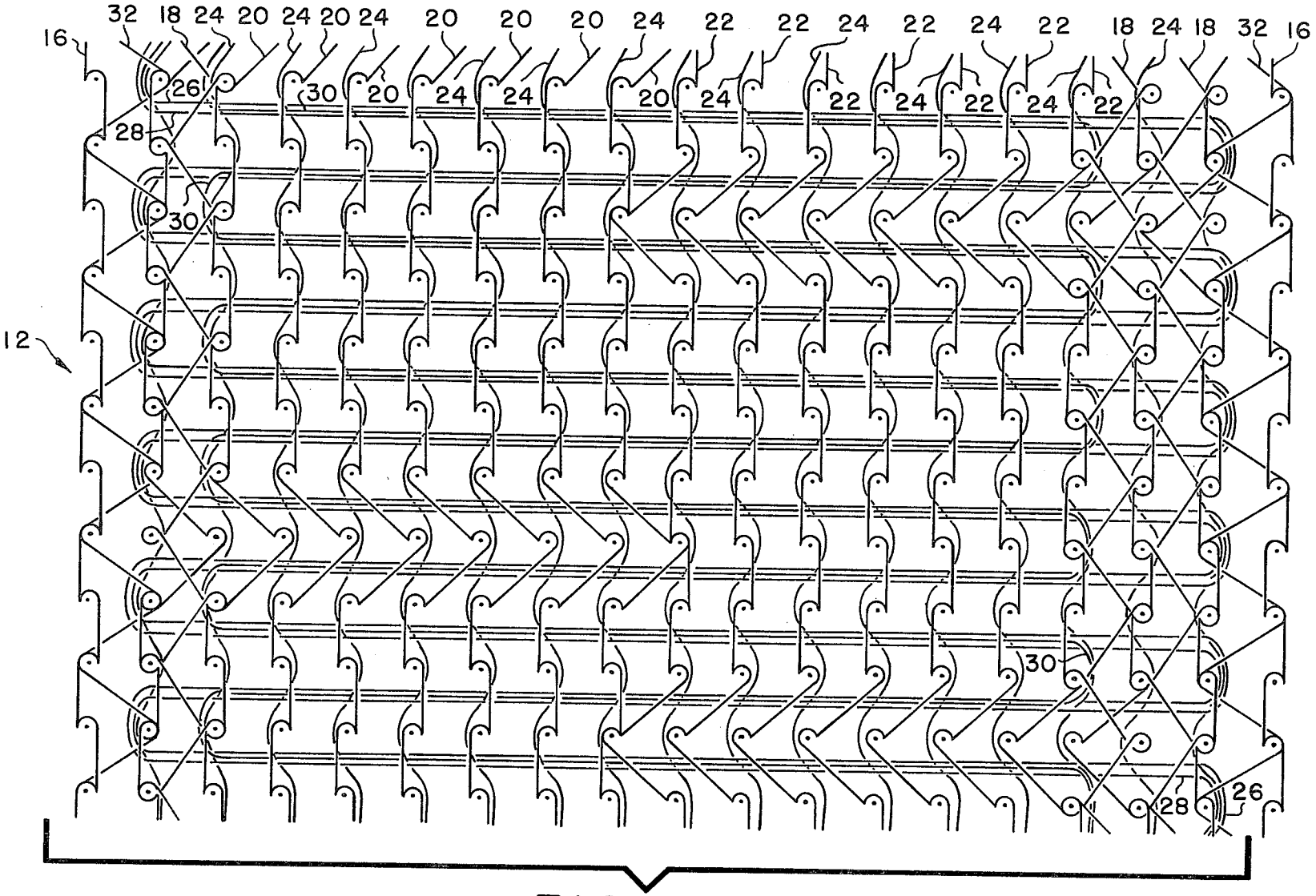
FIG. 2 is a point diagram of the new and improved fabric.
Figure 5:
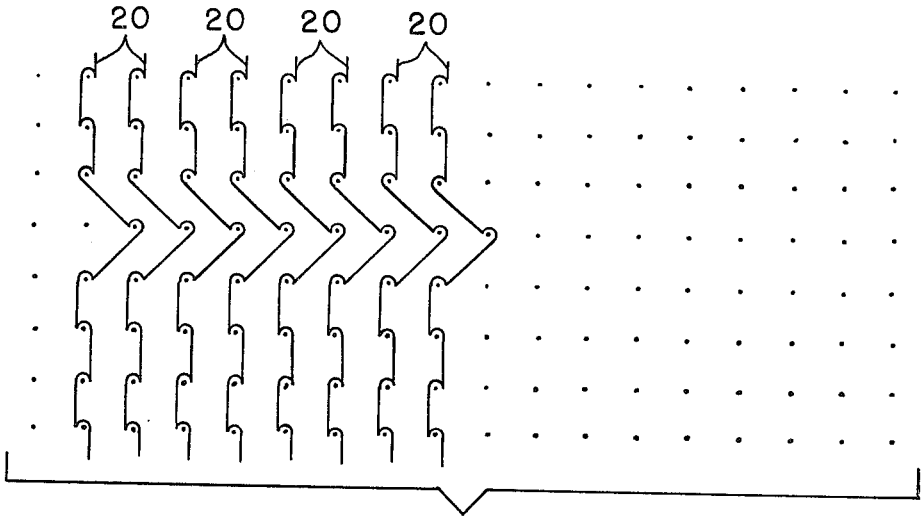
Figure 6:
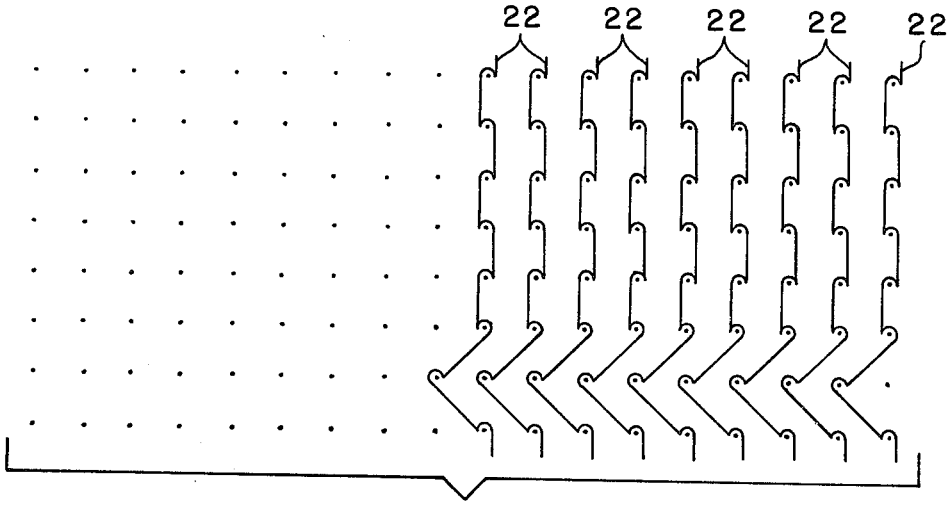

The fabric construction shown in FIGS. 2–11 is preferably knit on a Raschel warp knitting machine having at least nine guide bars to form the desired characteristics in the fabric. As discussed above, a wide width of fabric is knit with each tape 12 encompassing eighteen needles in the course direction with the overall design repeating every eight courses. FIG. 2 is a point diagram of the individual tapes or bands 12 while FIGS. 3–11 are point diagrams respectively, of guides 1–9 as shown in FIG. 2.

In forming the fabric of the drawings, the following bar movement patterns are employed:

Bar 1 (FIG. 3) 2-0, 0-2, 2-0, 0-2, 2-0, 0-2, 2-0, 0-2
Bar 2 (FIG. 4) 2-4, 2-0, 2-4, 2-0, 2-4, 2-0, 2-4, 2-0
Bar 3 (FIG. 5) 2-4, 4-2, 2-4, 4-2, 0-2, 4-2, 2-4, 4-2
Bar 4 (FIG. 6) 0-2, 4-2, 0-2, 2-0, 0-2, 2-0, 0-2, 2-0
Bar 5 (FIG. 7) 0-0, 34-34, 0-0, 34-34, 0-0, 34-34, 0-0, 34-34
Bar 6 (FIG. 8) 4-4, 0-0, 4-4, 0-0, 4-4, 0-0, 4-4, 0-0
Bar 7 (FIG. 9) 0-0, 28-28, 0-0, 28-28, 0-0, 28-28, 0-0, 28-28

Bar 8 (FIG. 10) 0-0, 2-2, 0-0, 2-2, 0-0, 2-2, 0-0, 2-2

Bar 9 (FIG. 11) 0-0, 34-34, 0-0, 34-34, 0-0, 34-34, 0-0, 34-34

The chain stitch 16 formed by bar 1 is a flat polyester 150 denier yarn which is employed in the fabric 10 to tie the individual tapes or bands 12 together until it is desired to separate the fabric 10 into the plurality of individual tapes or bands 12.

Tricot stitches 18 of 150 denier polyester yarns are used for the selvedges of the tapes 12 to prevent unraveling thereof while lock stitches 20 and 22 of 150 denier polyester yarn form a divided warp to provide strength to the fabric, prevent unraveling in the warp or wale direction and cover for the spandex yarn 24 laid in by the movement of bar 8. The stitches 20 and 22, respectively are controlled by the movement of bars 3 and 4.

Figure 7:
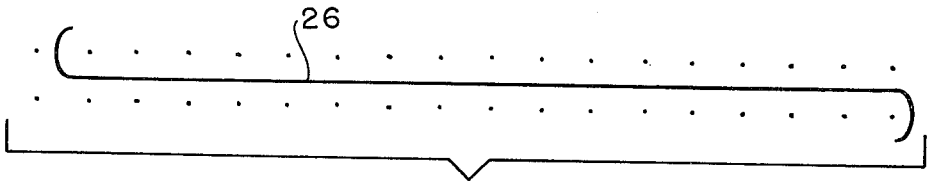
Figure 8:
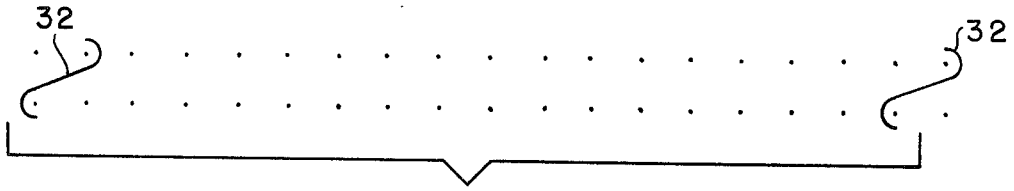
Figure 9:
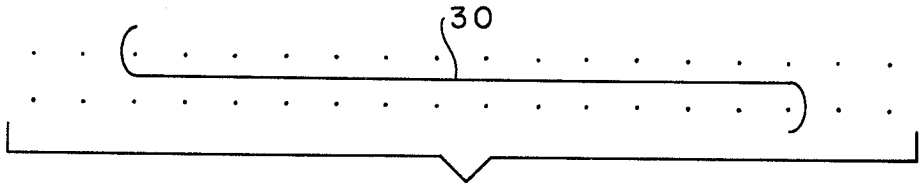
Figure 10:
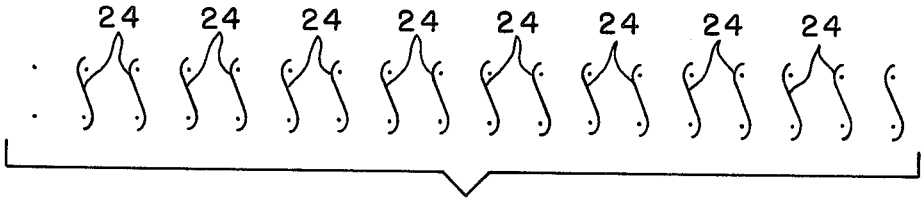
Figure 11:
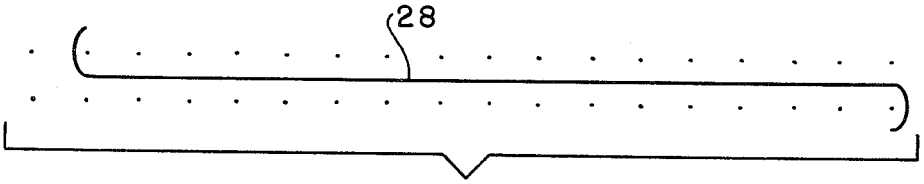

Bars 5 and 9 lay in yarns 26 and 28 of 150 denier textured polyester yarn between adjacent courses of the fabric 12 to provide top and bottom cover for the 800 denier polyester monofilament yarn 30, also laid in between adjacent courses of the fabric to provide rigidity in the fill or course direction of the fabric while the spandex yarn 24 provides elasticity in the warp or wale direction of the fabric. FIGS. 7 and 11, respectively show the lay in of the cover yarns 26 and 28 while FIG. 9 shows the lay in of the polyester monofilament yarn by bar 7.

To provide a connecting stitch, bar 6 guides in the yarn 32 of 70 denier polyester on both sides of the fabric 12 for interconnection with the chain stitch 16 which connects adjacent tapes or bands 12 together in the warp or wale direction to form the fabric 10.

As discussed briefly before the monofilament 30 is laid in between adjacent courses to provide rigidity in the course direction and follows a sinusoidal path throughout the length of the fabric. The rigidity of the monofilament prevents the tape 12 from bending when used as a waistband in a garment since it will be parallel to the standing position of a person wearing such garment. At the same time, the use of such a monofilament, if accidentally severed while being placed in a garment, will cause discomfort to the wearer of the garment. This accidental severing of the monofilament usually occurs where the monofilament reverses direction in the fabric adjacent one end thereof on the side of the fabric which is sewn to the garment and cut. To greatly decrease this possibility, this side of fabric 12, which the right-hand side on FIGS. 1–11, the monofilament is reversed at a point which is at a greater distance inward from the edge of the fabric than the reversal point of the monofilament at the other side of the fabric. This difference in distance is preferably equal to the spacing between two adjacent needles. To provide the skirt 15 on this side of the fabric, an additional selvedge yarn 18 is guided therein by bar 2 so that the reversal point of the monofilament is inwardly substantially from the edge of the tape 12.

As disclosed in the preferred embodiment, the tape is basically being knit using three bars, namely bars 2, 3 and 4 with bars 4–9 laying in yarn but, obviously, if desired, the tape can be knit using four bars, namely bars 1–4, with bars 4–9 laying in yarn, as disclosed.

It can readily be seen that a waistband fabric has been provided which can be manufactured in wide widths which can be readily separated to provide individual waistband fabrics that has rigidity in the course direction and elasticity in the wale direction.

Although the preferred embodiment of the invention has been described specifically, it is contemplated that many changes may be made without departing from the scope or spirit of the invention and it is desired that the invention be limited only by the scope of the claims.

I claim:

1. A warp knit elastic tape suitable for use as a waistband support in garments having a relatively high degree of stretch in the longitudinal direction and dimensional stability in the transverse direction comprising: a plurality of pairs of relatively inelastic yarns with each inelastic yarn forming single stitches in every course of the tape, a plurality of relatively elastic yarns inlaid in said stitches and extending across at least one wale of the tape from course to course, a relatively stiff and heavy continuous monofilament yarn inlaid between adjacent stitches in each wale and extending across the tape between every course, said monofilament yarn at the end of each course reverses direction at each side of the tape to pass through the next adjacent course with the reversal points of said monofilament yarn at one side of said tape being closer to the centerline of said tape than the reversal points on the other side of said tape and a skirt knit into each tape outside the reversal points on said monofilament yarn which is closer to the centerline of said tape.

2. A warp knit fabric of relatively wide width comprising a plurality of relatively narrow knit tapes positioned in side-by-side relation across the width of the fabric and joined at their side edges by a removable yarn, each narrow tape comprising a plurality of pairs of relatively inelastic yarns with each inelastic yarn forming single stitches in every course of the tape, a plurality of relatively elastic yarns inlaid in said stitches and extending across at least one wale of the tape from course to course, a relatively stiff and heavy continuous monofilament inlaid between adjacent stitches in each wale and extending between every course, said monofilament at the end of each course reverses direction at each side of the tape to pass through the next adjacent course with the reversal points of said monofilament yarn at one side of said tape being closer to the centerline of said tape than the reversal points on the other side of said tape and a skirt knit into each tape outside the reversal points of said monofilament yarn which is closer to the centerline of said tape.

3. The warp knit fabric of claim 2 wherein each of said inelastic yarns have an open loop tricot stitch in one wale to eliminate unraveling of said tape.

4. A warp knit elastic tape suitable for use as a waistband support in garments having a relatively high degree of stretch in the longitudinal direction and dimensional stability in the transverse direction comprising: a plurality of pairs of relatively inelastic yarns with each inelastic yarn forming single stitches in every course of the tape with each of said inelastic yarns having an open loop tricot stitch in one wale to eliminate unraveling of said tape, a plurality of relatively elastic yarns inlaid in said stitches and extending across at least one wale of the tape from course to course, a relatively stiff and heavy continuous monofilament yarn inlaid between adjacent stitches in each wale and extending across the tape between every course, said monofilament yarn at the end of each course reverses direction at each side of the tape to pass through the next adjacent course with the reversal points of said monofilament yarn at one side of said tape being closer to the centerline of said tape than the reversal points on the other side of said tape and a skirt knit into each tape outside the reversal points of said monofilament yarn which is closer to the centerline of said tape.

* * * * *